US007284676B2

(12) United States Patent
Dantani

(10) Patent No.: US 7,284,676 B2
(45) Date of Patent: Oct. 23, 2007

(54) LID WITH A FILTER AND THE FILTER THEREFOR

(76) Inventor: Shiho Dantani, Komonji 2-6-7, Kokurakita-ku, Kitakyusyu-shi, Fukuoka-ken 802-0037 (JP)

( * ) Notice: Subject to any disclaimer, the term of this patent is extended or adjusted under 35 U.S.C. 154(b) by 258 days.

(21) Appl. No.: 10/880,011

(22) Filed: Jun. 30, 2004

(65) Prior Publication Data

US 2005/0224503 A1 Oct. 13, 2005

(30) Foreign Application Priority Data

Apr. 13, 2004 (JP) ..... 2004-118073

(51) Int. Cl.
*A47G 19/22* (2006.01)
*B01D 24/00* (2006.01)

(52) U.S. Cl. ..... 220/711; 220/713; 220/719; 210/469

(58) Field of Classification Search ..... 220/711, 220/713, 703, 719, 212, 371, 718, 254.1, 220/717, 367.1, 254.7, 789, 730; 215/387, 215/355; 426/80, 77, 435; 210/469, 474, 210/495; 229/404, 906.1; 222/189.06, 565
See application file for complete search history.

(56) References Cited

U.S. PATENT DOCUMENTS 767,471 A * 8/1904 Barnett ..... 210/466
2,381,104 A * 8/1945 Burnham ..... 210/497.1
2,686,597 A * 8/1954 Lilja ..... 210/469
2,885,084 A * 5/1959 Rocca ..... 210/464
2,971,681 A * 2/1961 Galbierz ..... 222/548
3,593,880 A * 7/1971 Kulbacki ..... 220/697
4,589,569 A * 5/1986 Clements ..... 220/380
4,598,844 A * 7/1986 Morris ..... 222/196.2
4,999,109 A * 3/1991 Sabre ..... 210/244
5,168,140 A * 12/1992 Welker ..... 219/689
6,109,487 A * 8/2000 Hashimoto ..... 222/556
6,702,145 B2 * 3/2004 Malcolm ..... 220/713
6,889,859 B1 * 5/2005 Leon ..... 220/254.1

* cited by examiner

*Primary Examiner*—Robin A. Hylton
(74) *Attorney, Agent, or Firm*—Leighton K. Chong

(57) ABSTRACT

A lid for a cup is provided with a filter fitted into a sipping hole which filters solid objects, such as tea leaves, mixed into the beverages so that pure beverage can be drunk. In the preferred embodiment, the filter component is a coil spring 14 having hooking parts 20, 21 on the both ends thereof. In another embodiment, the filter component is a grid in an elastic body 56 which is snap-fitted into the sipping hole by the side edges thereof fitting into grooves formed at its ends. The filtered liquid can be drunk by filtering the substances (such as tea-leaves and herbs) inside of the cup 11 through this filter component.

4 Claims, 7 Drawing Sheets

LID WITH A FILTER AND THE FILTER THEREFOR

FIELD OF THE INVENTION

The present invention relates to a lid with a filter and the filter therefore, which is adequate for making green tea or tea and so on, or brewing herbs and so on with a cup made of paper or plastic.

BACKGROUND OF THE INVENTION

It is well known that a lid is capped on a cup made of paper and plastic as described in the prior patent document 1. It prevents inside beverage from being cold and the contents from spilling easily.

The prior patent or UM documents 2 and 3 disclose a lid for a cup with a drinking hole.

The prior patent document 1: Japanese Patent Kokai No. 2002-284206 (A)

The prior patent document 2: Japanese Patent Kokai No. 2002-240841 (A)

The prior UM document 3: Japanese UM Registration No. 3036444 (B2)

DETAILED DESCRIPTION OF THE INVENTION

In the lid as shown in the prior patent document 1, the lid for cup as shown in the prior patent document 2 and the cup capped with a lid having a drinking hole as shown in the prior UM document 3, an opening is made at a part of the lid so that the inside beverage can be poured through it. Of course, when the beverage is green tea or tea, tea leaves may mix with the beverage. If a filter package in which tea leaves are packed is soaked into a cup, the tea leaves do not mix with the beverage. However, the amount of tea leaves or strength of tea depends on personal preference and the kinds of packed tea leaves are limited so that the demand of tea maniac could not be met. Also, the packed tea has a problem that it doesn't jump in the beverage.

This kind of problems is commonly happened to not only tea and green tea but also something to brew for drinking and beverages into which solid objects mix.

Taking all the above-mentioned problems into consideration, present invention is made and a purpose of the present invention is to provide a lid with a filter which filters solid objects, such as tea leaves, mixed into the beverages so that pure beverage can be drunk, and a filter therefor.

The lid with a filter is a lid to cap a cup, wherein a small hole is made at a part of a ceiling board and a liquid permeable filter component which is made differently from the ceiling board is attached on the above small hole. The filter component consists not only of elastic component but also of non-elastic component. The non-elastic component can be used because when a cup itself consists of an elastic material or a partly deformable material and the size of the components is slightly bigger than that of a small hole, the component is securely fitted into the small hole.

The lid with a filter in one embodiment comprises that the filter component is made of elastic material and is detachably fitted to the small hole. The elastic component is reduced its size a little bit when fitted into the small hole, then a part or the whole of the component is restored so that it is not easy to fall away after fitting.

The lid with a filter further comprises that the filter component is a coil member having hooking parts on the both ends thereof and the small hole has a rectangle portion into which the coil body except the hooking parts of the coil member is closely fitted. The coil body is positioned inside the cup and expands the dimension to filter the liquid passing through the small hole so that it is difficult to become stuck.

The lid with a filter further comprises that the coil member is made of corrosion resisting metals or synthetic resins. The corrosion resisting metals are, for example, stainless steels. It is preferable that the synthetic resins can resist the 100 degrees and keep their shape and elasticity.

The lid with a filter further comprises that said hooking parts are formed by extending or bending the end portions of said coil member along the lateral line of said coil body. With this arrangement, the main part of the coil body can be fitted in the small hole.

The lid with a filter further comprises that one said small hole is made at the margin of said ceiling board or the vicinity thereof.

The lid with a filter in a further embodiment comprises that said filter component is made of synthetic resin which has a plurality of filtering holes and grooves on both sides at least in longitudinal direction to which the above ceiling board facing said rectangular hole is fitted.

The filter is to be used by fitting into a rectangular hole of a lid capping a cup, said filter comprises a coil member having hooking parts on the both sides thereof. Said hooking parts have an effect to prevent the coil member from dropping into the rectangular hole. Besides, it enables the coil body to be fixed to the lid with the coil member being inserted in the rectangular hole.

The filter further comprises that, the above hooking parts are formed by bending the both end portions of said coil member.

The filter as defined is a filter to be used by fitting into a rectangular hole of a lid capping a cup, said filter is made of synthetic resin which has a plurality of filtering holes and grooves on both sides at least in longitudinal direction to which said ceiling board facing said rectangular hole is fitted.

In the above inventions, the shape of hooking part is any configurations such as round-shape, square-shape, heart-shape, spade-shape and so on.

In the lid with a filter according to the embodiments, filtered liquid can be drunk by filtering the substances (such as tea-leaves and herbs) inside of the cup through this filter component, because a small hole is opened at the part of the ceiling board and the filter component which has permeability to liquid is attached on the small hole.

The filter can be exchanged when it becomes stuck after repeated use or get filthy, because the filter component is made of an elastic component and is detachably set in the small hole. The lid can be used repeatedly, too.

Because the filter component has a coil member having hooking parts on the both side of the components, the coil member can be fixed in the rectangular hole formed at the lid. Moreover, the hooking parts have an effect to prevent the coil member from falling into the rectangular hole.

Because the coil member is made of corrosion resisting metals or synthetic resins, it can be used repeatedly and it can be washed easily when it becomes dirty.

Because the hooking parts are formed by bending the edges of the coil members, it is easy to form them and the cost to form them becomes low.

Because the small hole is made on the margin of said ceiling board or the vicinity thereof, the filtered beverage can be drunk easily by leaning the cup.

Because the filter component is made of synthetic resins, it can be manufactured easily at a low price and disposed easily as well.

Because it comprises the coil member having the hooking parts on the both sides thereof, it can be produced very easily and washed to be clean easily as well.

Because the filter comprises the coil member having the hooking parts made by bending the both end portions of the coil member, general material for producing springs can be used.

Because the filter is made of synthetic resin, it can be produced easily at a low price. Moreover, since the grooves are made on both sides in a longitudinal direction, it has an effort that the filter shall not be taken off, fitting on the edge of a ceiling board accurately which faces said rectangular hole.

THE BEST MODE FOR EMBODYING THE PRESENT INVENTION

Embodiments of a lid with a filter according to the present invention will be described herein below in detail with reference to the attached drawings to make it useful to understand the present invention.

Figure 1:
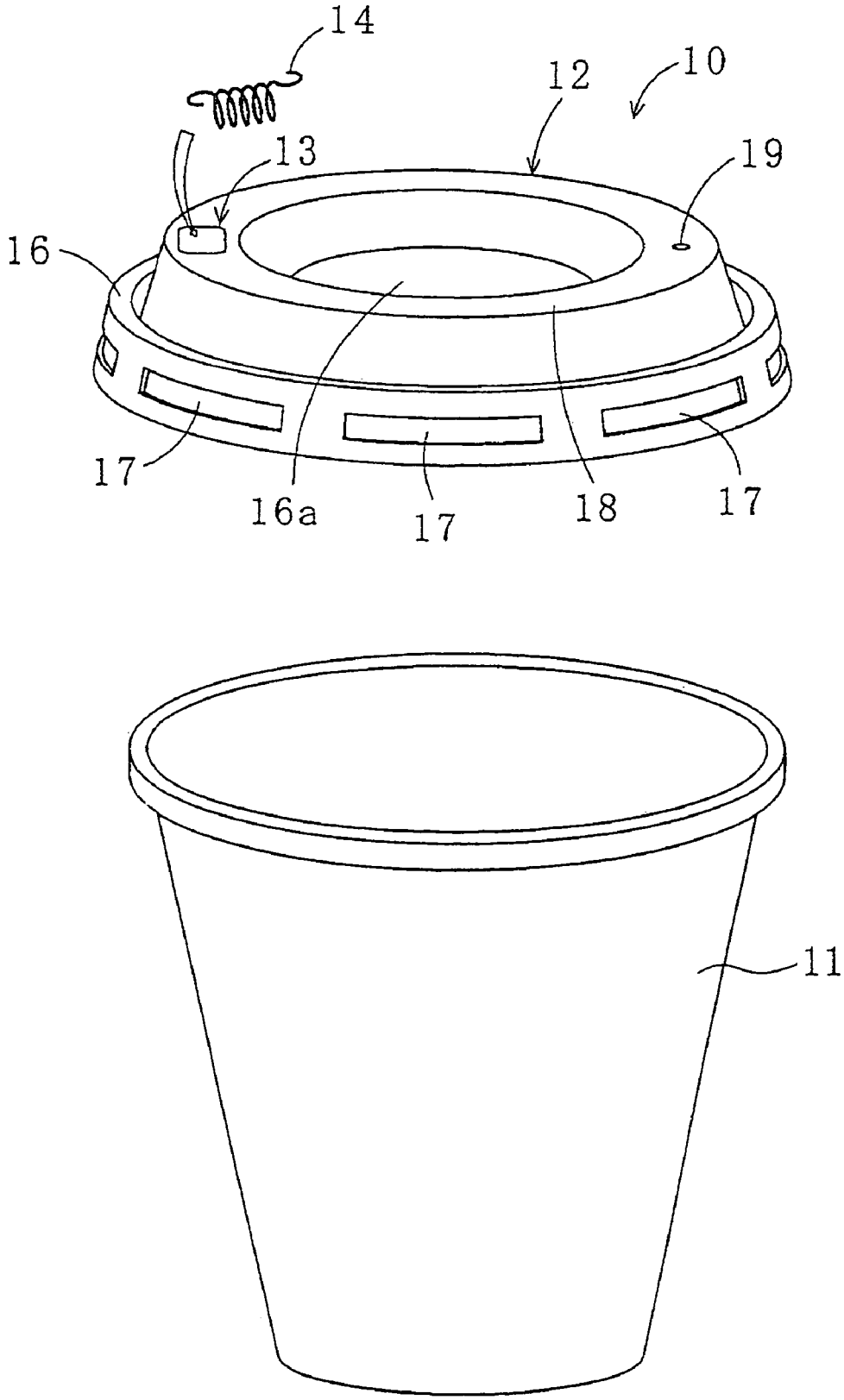
FIG. 1 is a perspective view of a first embodiment of a lid with a filter according to the present invention.
Figure 2:
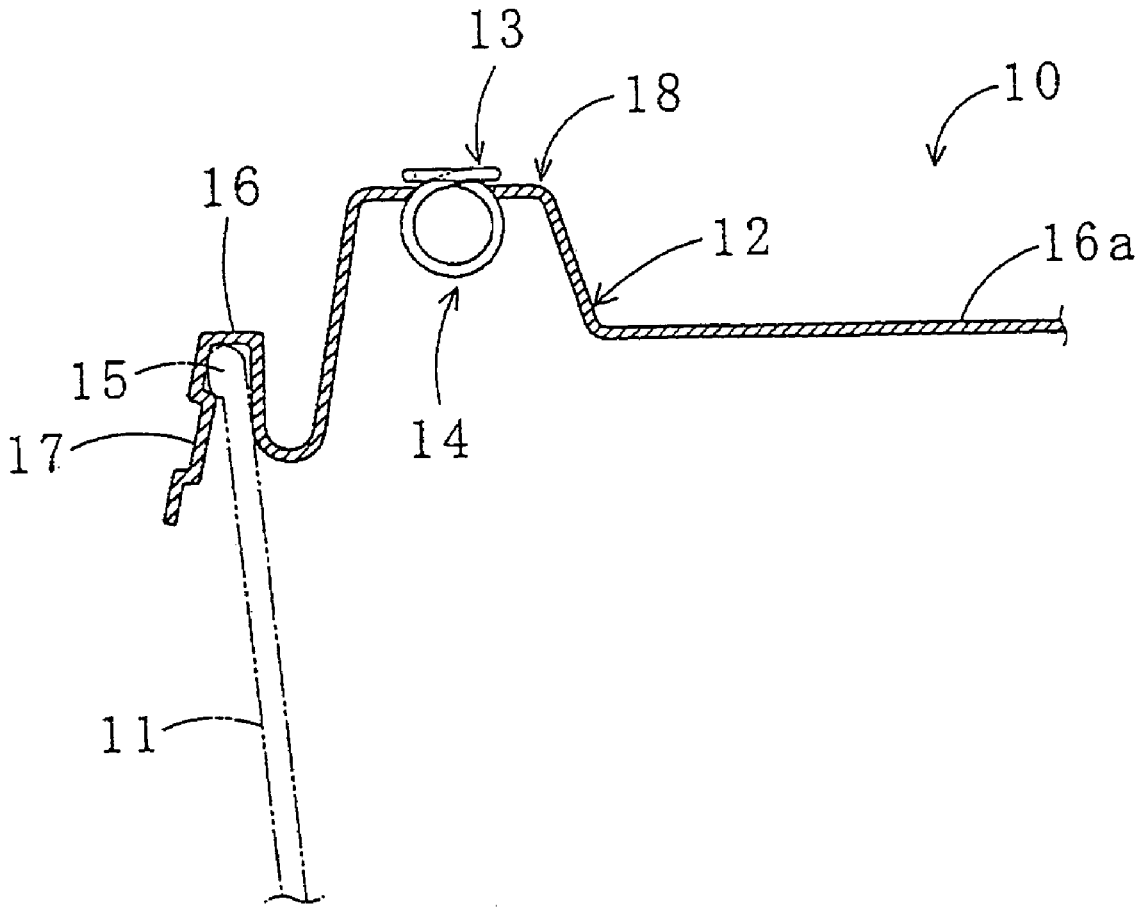
FIG. 2 is a partial vertical-section view of the lid with the filter as shown in FIG. 1.
Figure 3A:
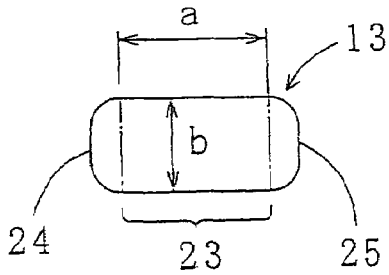
FIG. 3A is a plan view of a hole shaped as a rectangle.
Figure 4A:
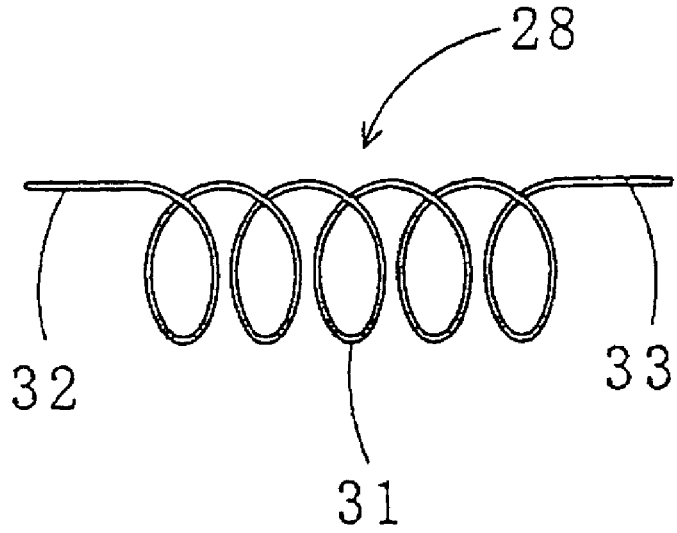
FIG. 4A is a front view of a second embodiment of a filter according to the present invention and FIG. 4B is a vertical section view of the same.
Figure 4B:
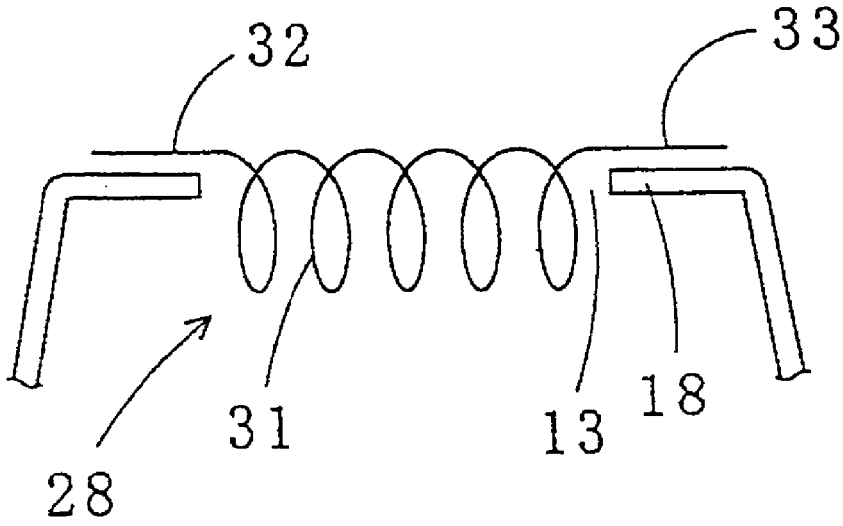
Figure 5A:
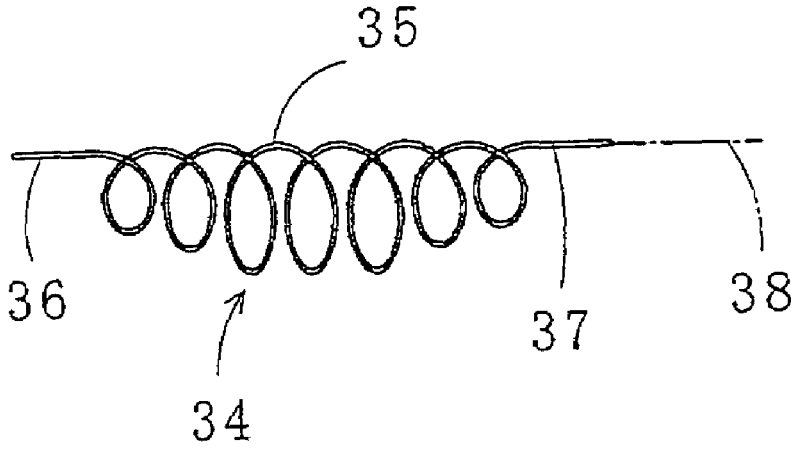
FIG. 5A is a front view of a third embodiment of a filter according to the present invention.
Figure 5B:
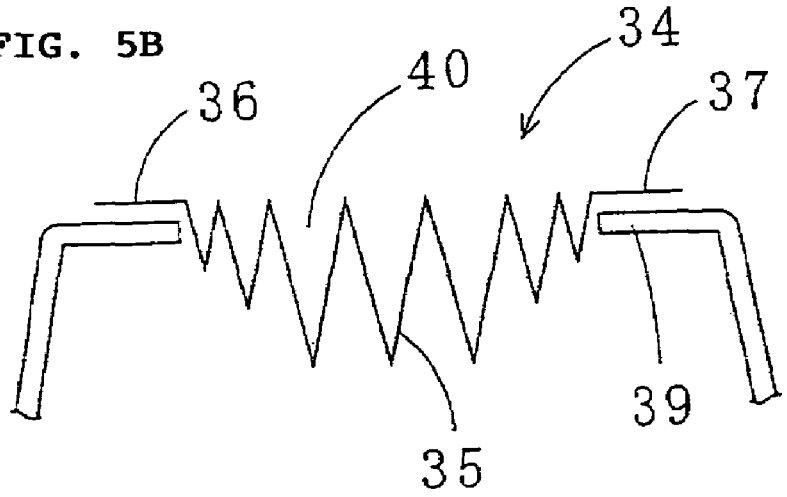
FIG. 5B is a vertical section view of the same as used condition.
Figure 5C:
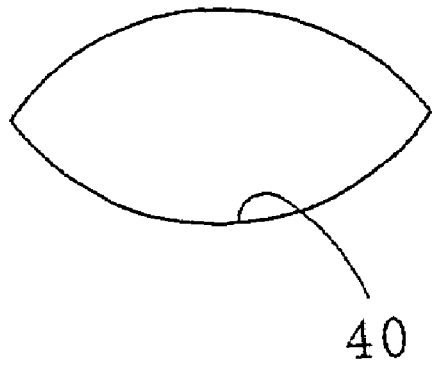
FIG. 5C is a plan view of a small hole.
Figure 6:
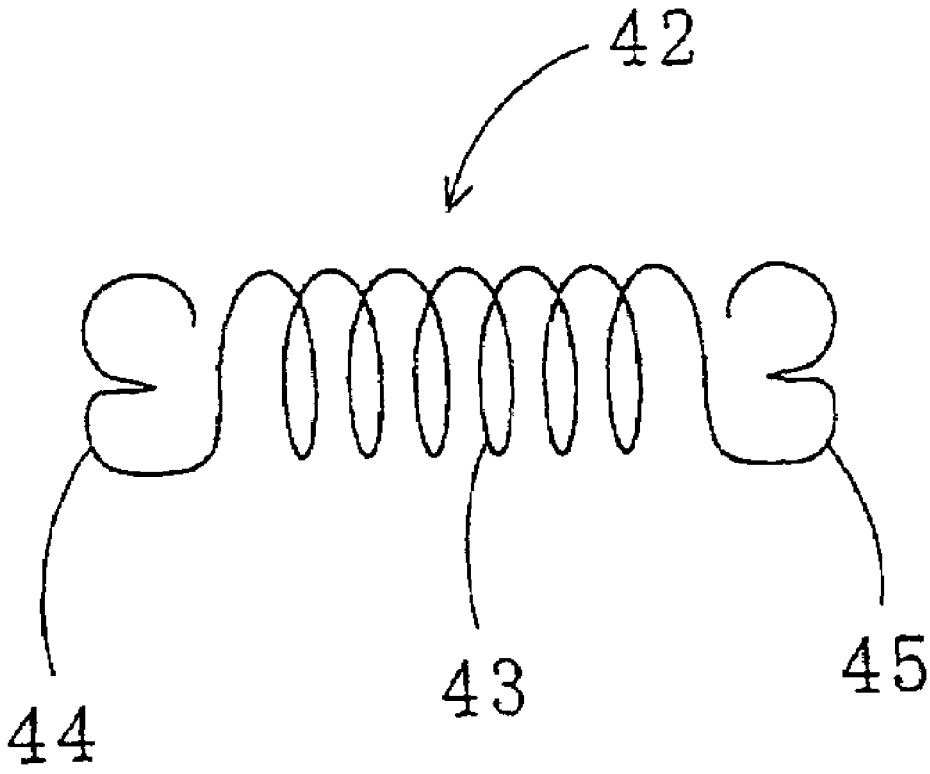
FIG. 6 is a plan view of a forth embodiment of a filter according to the present invention.
Figure 7A:
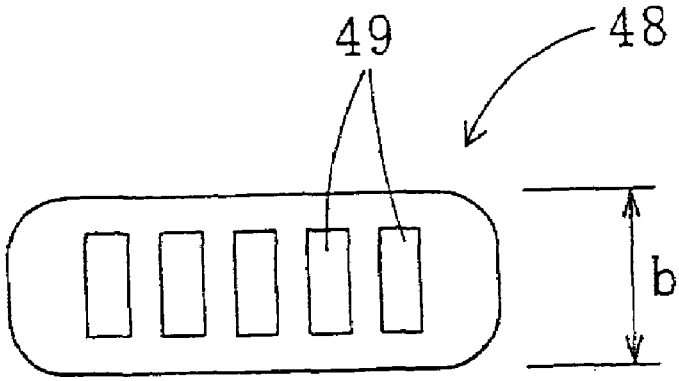
FIG. 7A is a plan view of a fifth embodiment of a filter according to the present invention and FIG. 7B is a vertical-section view of the same as used condition according to the present invention.
Figure 7B:
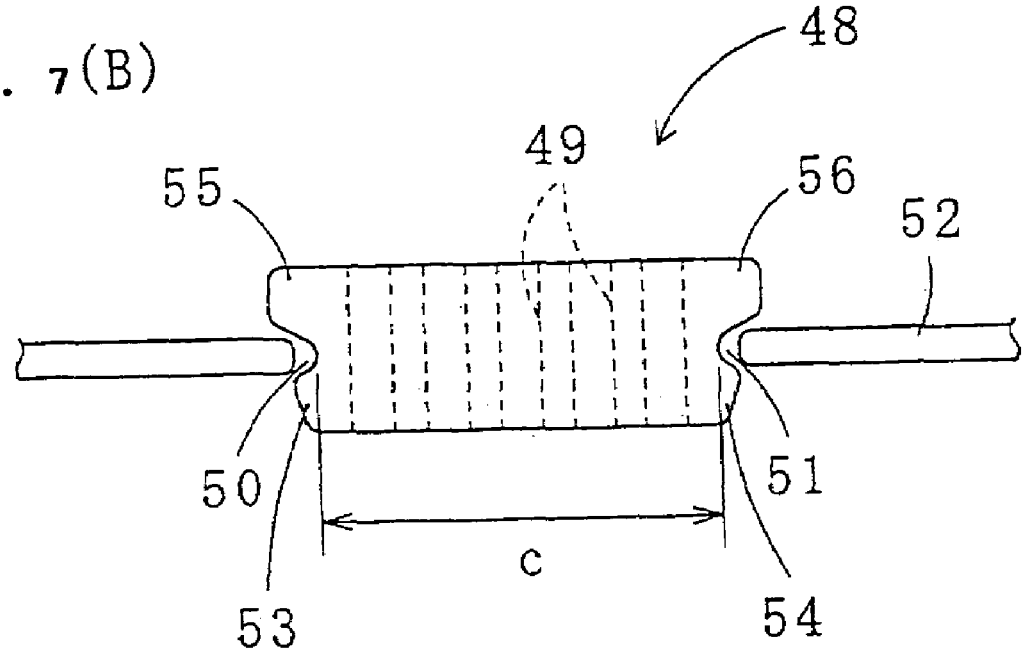

FIG. 1 is a perspective view of a first embodiment of a lid with a filter according to the present invention. FIG. 2 is a partial vertical-section view of the lid with the filter as shown in FIG. 1. FIG. 3A is a plan view of a hole shaped as a rectangle and FIG. 3B is a plan view of a coil spring. FIG. 4A is a front view of a second embodiment of a filter according to the present invention and FIG. 4B is a vertical section view of the same. FIG. 5A is a front view of a third embodiment of a filter according to the present invention, FIG. 5B is a vertical section view of the same as used condition, and FIG. 5C is a plan view of a small hole. FIG. 6 is a plan view of a forth embodiment of a filter according to the present invention. FIG. 7A is a plan view of a fifth embodiment of a filter according to the present invention and FIG. 7B is a vertical-section view of the same as used condition according to the present invention.

As shown in FIG. 1 and FIG. 2, the lid with a filter 10 according to the first embodiment of the present invention is made of thin plastic materials or metallic materials. The lid with a filter 10 comprises a lid 12 that is put on the cup 11 and the coil spring 14 that is one example of coil members consisting of liquid permeable filter components. The coil spring 14 is fitted into the rectangular hole 13 (one example of small holes) opened on a part of the ceiling board of this lid 12.

In this embodiment of the invention, the cup 11 has a characteristic that it is a paper or plastic receptacle shaped circular truncated cone and an evaginated rim 15 (one example of curled parts) of the cup 11 is made by bending the top of the cup toward outside. The lid with a filter 10 comprises a cyclic snap-on part 16 fitting on the evaginated rim of the cup. This cyclic snap-on part is made by forming the periphery of the lid into U-shape in the vertical-section. A plurality of dents 17 projecting inwardly are formed on the outside wall so that the evaginated rim 15 of the cup 11 does not come off easily once it has fitted on the cyclic snap-on part 16. Moreover, a seal to prevent the inside beverage from spilling is made between the evaginated rim 15 and the cyclic snap-on part 16 by abutting each other.

Inward of the cyclic snap-on part 16, a cyclic protuberant part 18 which has a certain width in a radial direction and are composed of a part of a ceiling board is comprised. The width of the cyclic protuberant part 18 is, for example, made in the 0.15r~0.35r range to the radius "r" of the lid with a filter 10. Besides, on the middle of one side of the surface of the cyclic protuberant part 18, an air vent hole 19 the diameter of which is, for example, 0.3~1 mm and the shape is circle is opened, while on the other side of the surface of the cyclic protuberant part 18 the above-mentioned rectangular hole 13 is made. In other words, the air vent hole 19 is made on opposite side of the rectangular hole 13 on the projecting surface of cyclic protuberant part 18. Moreover, a cyclic ceiling part that comprises a circular ceiling 16*a* is made inside of the cyclic protuberant part 18.

On this rectangular hole 13 the coil spring 14 made of elasticity components that has hooking parts 20, 21 on the both sides thereof is attached. The shape of the rectangular hole 13 is decided depending on the shape of the coil body 22 of the coil spring 14. For example, as shown in FIGS. 3A and 3B, the shape of the coil body except the hooking parts 20 and 21 is formed into a rectangular in a plan shape. Therefore, if the width of it is "d" and the length of it is "c", it is preferable to set the width "b" and the length "a" of an oblong part 23 of the rectangular hole 13 to which the coil body 22 is fitted in the following equations.

$$b=(0.9\sim1)\times d$$

$$a=(0.8\sim0.99)\times c$$

Besides it is preferable to make the shape and area of side parts 24, 25 of the rectangular hole 13 as small as possible. The present invention is applied even if its shape is semi-circle or oblong.

Moreover, in the preferred embodiment shown in FIG. 3B, the hooking parts 20, 21, that are formed by bending at a 90-degree angle to extend in parallel to the central axis of the coil spring 14, extends in a hypothetical plan X with which the coil body 22 is in contact (see FIG. 3C). These hooking parts 20, 21 can also be formed by bending the end portions of the coil body 22 in a 90-degree angle to let them protrude outside of the rectangular hole 13 (see FIG. 3D).

Thus, the hooking parts 20, 21 extend in a hypothetical plan Y that are parallel to the hypothetical plan X but intersects the coil body 22 at a different height (0.5d~0.9d) (same as in the following embodiment).

A size of the coil body 22 is preferable to being set in, for example, d=4~10 mm, c=8~20 mm range but the present invention doesn't limit this size so that both smaller and bigger size are acceptable.

When the diameter of the coil body 22 becomes larger, or the pitch of the coil body 22 becomes big, a smaller coil or liquid permeable metallic fibers and so on should be inserted into the coil body 22 to prevent foreign materials such as tea leaves from coming out of the cup 11.

In this embodiment according to the present invention (same as in the following embodiment), a coil spring is made of stainless steel, which is one example of corrosion resisting or anti-rust metal but it can also be made of synthetic resin having elasticity.

In order to attach the coil spring 14 on the rectangular hole 13, the coil spring 14 is put on the rectangular hole 13 and is pushed. The coil spring 14 is fixed to the rectangular hole 13 by means of the hooking parts 20, 21 that are put on the cyclic protuberant part 18. More specifically, the opposite edges of the rectangular hole 13 fit into the shallow dent 20*a*, 21*a* of the hooking parts 20,21 so as not to fall off easily.

In order to use this lid with a filter 10, the lid with a filter 10 is capped on a certain size of the cup 11 which includes green tea, tea or herbs and certain amount of hot water, as shown in FIG. 2. Next, the coil spring 14 is put on the rectangular hole 13 that is made at the periphery of or its vicinity of the ceiling board of the lid 12. By leaning the cup 11, filtered green tea, tea, herb can be poured or can also be drunk directly putting lip on the rectangular hole 13.

The lid with a filter 10 on which the coil spring 14 is attached can be used repeatedly.

In the following section, the second to forth embodiments of the filter according to the present invention as shown in FIG. 4 ~FIG. 6 will be explained.

A coil spring 28 which is one example relating to a second embodiment of the present invention as shown in FIG. 4A comprises a coil body 31, the shape of which is actually the same as the coil body 22 of the coil spring 14 relating to the first embodiment and hooking parts 32 and 33 that are straight. Because the tips of the hooking parts 32 and 33 are not safe to be handled, the end portions thereof had better be turned back, or be shaped into a semicircle having small diameter and then bent (same as in following embodiment). FIG. 4B shows the condition that this coil spring 28 is attached on the rectangular hole 13 of the cyclic protuberant part 18.

Of course, the present invention can be applied to a lid without this cyclic protuberant part 18.

A coil spring 34 which is one example of a filter relating to a third embodiment of the present invention as shown in FIG. 5A comprises a coil body 35, the shape of which is barrel shape, and hooking parts 36 and 37 that are made on both sides. Diameter of each coil of the coil body 35 has small at both sides and it gradually becomes big toward in the middle. One edge line 38 (a ridge line) of the coil body 35 is straight. Also, the hooking parts 36 and 37 extend on extension of the edge line 38. It prevents opening areas on the both sides of the coil body 35 from being formed and makes efficiency of filtering increase. In this case, a small hole 40 which is made on a ceiling board 39 of the lid with a filter as shown in FIG. 5B and FIG. 5C is preferable to being made small a little bit (in the ranges such as in 80~99% range) and a similar shape of the coil body 35. It enables the coil body 35 to be fixed accurately in the small hole 40 and filtering can be performed as well.

Next, a coil spring, which is one example of a filter relating to forth embodiment of invention as shown in FIG. 6, will be explained. Hooking parts 44 and 45, which are made on the both sides of a coil body 43, are formed into heart configuration. With this configuration, the protuberant parts of the wire disappear and aesthetic characteristic as a design is enhanced.

The shape of the coil body 43 is acceptable if it is both a circular cylinder and a barrel shape.

Figure 3:
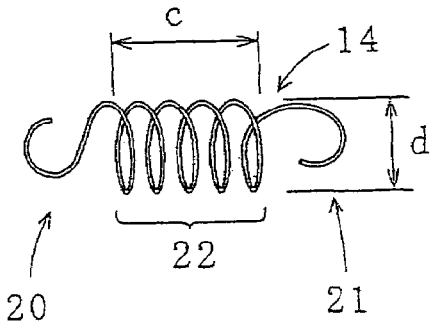
FIG. 3B is a plan view of a coil spring.
FIG. 3C is a perspective view of an other embodiment of a coil spring.
FIG. 3D is a perspective view of another embodiment of a coil spring.
Figure 3:
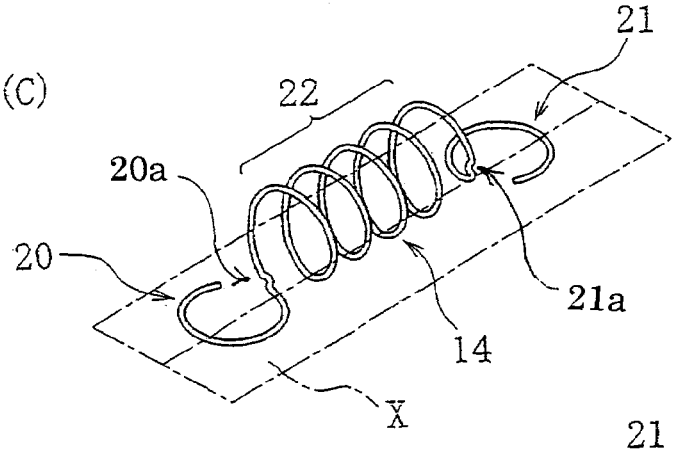
Figure 3:
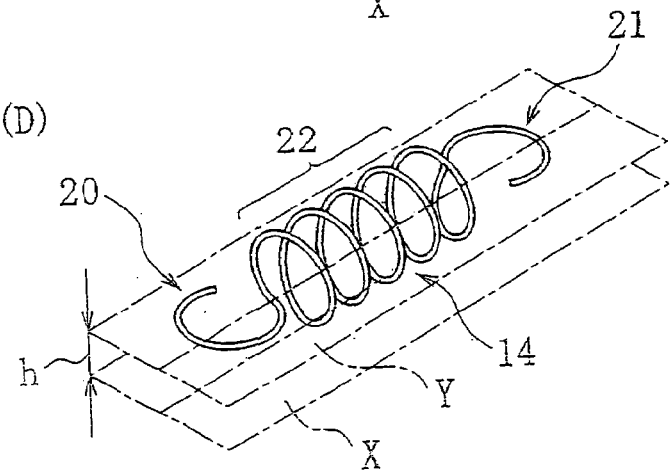

As shown in FIG. 7A and FIG. 7B, a filter 48 relating to a fifth embodiment of the present invention is made of synthetic resins such as polyethylene resin, ABS, polypropylene, polycarbonate etc. and is shaped into an oval in a plan view. The filter 48 has a plurality of filtering holes 49 passing completely therethrough. It also comprises grooves 50 and 51 on both sides in a longitudinal direction and has a width "b" to be fitted into the rectangular hole 13 made on ceiling board 52 (as shown in FIG. 3), and a length in a longitudinal direction is longer than a whole length of the rectangular hole 13. A distance "c" between the bottoms of the grooves 50 and 51 (for example, about 10~30 mm) is equal to the whole length of the rectangular hole 13. The depths of the grooves 50 and 51 into which a ceiling board 52 facing the rectangular hole 13 is fitted are about 0.2~2 mm. Under protuberances 53, 54 which comprise grooves 50 and 51 is shorter than an upper protuberance 55, 56 and the shape of the under protuberance is inclined toward inside as goes down. Therefore, the filter 48 can be pushed easily into the rectangular hole 13.

In the above-mentioned embodiments, the small hole comprises a rectangular hole and is formed along a circumference direction of a circle. Alternatively, it may be formed in a radial direction (thus, the small hole 13 is turned at a 90-degree as shown in FIG. 1). In this embodiment, the air vent hole 19 can be omitted because the filtered liquid such as tea flows out of the small hole at a radially outside position while air flows in the cup at a radially inside position.

Also, in the above-mentioned embodiment, a filter (or filter component) is made of synthetic resin which comprises a coil spring or filter having a plurality of filtering holes, but present invention accepts not only these materials but also any other materials (such as resins or metals which have a plurality of minute holes that are liquid permeable filter components that fit into the small hole of the ceiling board of the lid.

It should be understood that many other modifications and variations may be devised given the above description of the guiding principle of the invention. It is intended that all such modifications and variations be considered as within the spirit and scope of this invention, as defined in the following claims.

What is claimed is:

1. A lid to cap a cup, wherein a small hole is made in a part of a ceiling board used to form the lid, and a liquid permeable filter which is made separately from the ceiling board is attached over said small hole, wherein said liquid permeable filter component is a coil spring having a series of coils through which liquid can pass, and wherein said small hole has an elongated shape with a given length in a longitudinal direction thereof, and said coil spring has a length across the series of coils which when the coil spring is uncompressed is greater than the length of the small hole, such that said coil spring is attached over said small hole by compressing the coil spring and inserting the compressed series of coils into the small hole, and said coil spring further having hooking parts extending longitudinally on opposite ends of the series of coils which overlie respective outer surfaces of the ceiling board on opposite sides of the length of the small hole so as to retain the coil spring thereon.

2. The lid with a filter according to claim 1, wherein the coil member is made of corrosion resisting metals or synthetic resins.

3. The lid with a filter according to claim 1, wherein said hooking parts are bent end portions of said coil spring.

4. The lid with a filter according to claim 1, wherein said small hole is made at the margin of said ceiling board or the vicinity thereof.

* * * * *